US006336249B1

(12) United States Patent
Plumley

(10) Patent No.: US 6,336,249 B1
(45) Date of Patent: Jan. 8, 2002

(54) PLASTIC ELONGATED HINGE

(76) Inventor: Roger Plumley, 918 N. Eastern Ave., Los Angeles, CA (US) 90063

( * ) Notice: Subject to any disclaimer, the term of this patent is extended or adjusted under 35 U.S.C. 154(b) by 0 days.

(21) Appl. No.: 09/340,516

(22) Filed: Jun. 28, 1999

(51) Int. Cl.[7] ..... E05D 1/06; E05D 3/06

(52) U.S. Cl. ..... 16/225; 16/234; 16/387; 16/DIG. 13; 16/261; 16/262; 16/263

(58) Field of Search ..... 16/225, 234, 387, 16/DIG. 13, 262, 263, 261; 264/318; 156/292, 295

(56) References Cited

U.S. PATENT DOCUMENTS

| | | | | | |
|---|---|---|---|---|---|
| 2,484,581 | A | | 10/1949 | Pallmen | |
| 3,019,486 | A | | 2/1962 | Stinson | |
| 3,497,908 | A | * | 3/1970 | Zamarra | 16/171 |
| 4,231,135 | A | | 11/1980 | Fradin | |
| 4,651,382 | A | * | 3/1987 | Krolick | 16/124 |
| 5,398,377 | A | * | 3/1995 | Takiyama | 16/228 |
| D432,388 | S | | 10/2000 | Plumley | |
| 6,151,757 | A | * | 11/2000 | Beals | 16/380 |

OTHER PUBLICATIONS

H.A. Guden Co., Inc.–cov 84: pg 7; Stocker Hinge–Continuous Hinge brochure; pg. 5.

* cited by examiner

*Primary Examiner*—Anthony Knight
*Assistant Examiner*—Matthew E. Rodgers
(74) *Attorney, Agent, or Firm*—Bruce A. Jagger

(57) ABSTRACT

An improved plastic elongated hinge having an open spine and being adapted to replace a conventional piano hinge at a significantly reduced cost. The plastic elongated hinge includes at least two spaced apart pivotally pinned connections. The open spine permits the elongated hinge to be produced using substantially less plastic material. The hinge is preferably injection molded, and the pivotal connections are short in order to reduce the throw of the mold pins and thus maximize the production cycle time. An entirely integral snappedly engaging pivot connection is provided when more than two pivot connections are required. The entirely integral snap engagement connections require no moveable mold pins. This further reduces the costs of the hinge. Preferably, the elongated hinge is solvent bonded to plastic hinged members.

4 Claims, 7 Drawing Sheets

PLASTIC ELONGATED HINGE

BACKGROUND OF THE INVENTION

1. Field of the Invention

The invention relates in general to plastic hinges and, in particular, to an improved injection molded plastic elongated hinge adapted for use as an alternative to a conventional piano hinge. Elongated plastic hinges according to the present invention have open spines with spaced apart pivot connections. A substantial amount of material is saved as compared to a conventional piano hinge with a full spine. The assembly of the elongated open spine hinges to hinged members is facilitated. The molding costs are reduced. Both the manufacturing and maintenance of the mold are simplified, and the costs of manufacturing and maintaining the mold are reduced. The cycle time necessary to mold the parts of the open spine hinge is substantially reduced. The open spine hinge can also include a snapped together pivotal connection, if desired.

2. Description of the Prior Art

In many industries, an increasing number of parts and articles are made from plastic. In many instances, these parts are made entirely of plastic. There is also an increasing need for all plastic containers having hinged covers, such as, for example, in the computer industry, toy industry, hardware industry, retail display industry, and the like. In general, where lightweight plastic hinged members such as, for example, flat, transparent, semi-rigid panels are hingedly mounted to containers it is preferred to use continuous plastic hinges such as piano hinges. Continuous hinges generally extend substantially the full length of the edge of the hinged members to which they are mounted. Continuous hinges lend rigidity to the hinged members so that, among other things, the hinged members are easier to assemble and operate, and lighter and less expensive to produce.

Competition in supplying continuous plastic hinges is intense. Profit margins resulting from the mass production of such plastic hinges are very slim, often measured in fractions of a cent per part. Thus, reducing the cost of producing one hinge by just a fraction of a penny can have a significant impact on the economics of producing such plastic hinges. Those skilled in the art recognize that there is a need to mass-produce continuous plastic hinges at the lowest possible cost, consistent with providing a satisfactory product.

Many designs require the use of a continuous hinge configuration commonly known as a "piano hinge", particularly when the members to be joined by the hinge are not strong enough or tough enough to fully support themselves or sustain abuse during rough use. Such use includes, for example, the rotatable joining of relatively thin transparent plastic panels as hinged covers on display cases or containers. Piano hinges are often used to supportably hinge other elongated semi-rigid panels or members. In general, such piano hinges are adapted to extend substantially the full length of an edge of at least one of the hinged members to which it is mounted. Generally, a conventional piano hinge is an elongated hinge wherein the two leaf members of the hinge have a substantial plurality of knuckle or lug portions arrayed along the adjacent edges of the respective leaf members that, when assembled together with a common pivot pin, provide a pivot connection between the two leaf members. The spaced apart knuckles or lugs on each edge define generally cylindrical channels that taken together define an elongated channel. The knuckle or lug portions are located on the edge of each hinged member with the knuckles or lugs on one edge being offset from those on the other. Thus, when the respective edges of the hinged members are brought together the knuckles are interposed or intermeshed. When the knuckle portions are intermeshed and pivotally engaged by a long hinge pin extending generally coaxially through the combined elongated channel, they enable the hinged members to rotate about a hinge axis which is generally coextensive with the longitudinal axis of the hinge pin. The leaf members provide structural support and transfer associated loads through the long hinge pin connection. In contrast, a typical hinge configuration, where the hinge does not extend substantially the full length of the edge of the hinged member, is generally short and will only have a total of 2 or 3 knuckle portions pivotally engaging the leaf members. Generally such hinges do not provide the structural support which is provided by piano hinges. Thus, they generally serve a somewhat different and more limited function. Short hinges, for example, butt or mortise hinges, are often mounted in pairs, the individual ones of which are spaced apart along the edges of the hinged members by a considerable distance. As those skilled in the art recognize, the holes of every knuckle portion of every hinge on the edge of a hinged member must be in alignment so that the hinges will not bind as they are rotatbly activated. When the knuckle portions are not mounted on common leaves, it is difficult to establish and maintain proper alignment. Considerable skill, effort and time are required to mount such separate hinges at spaced apart locations on a structure. In a conventional piano hinge, the problem of maintaining proper alignment between the knuckle portions is generally solved by providing knuckle or lug portions along the full length of the continuous hinge leaves so that the elongated channel defined between them when they are interposed with one another is substantially continuous. The requisite alignment is provided during the manufacturing of the hinge elements because all of the knuckles or lugs on one leaf are aligned at the time of manufacture, not during assembly to a hinged member.

As those skilled in the art realize, mass-produced plastic parts, such as continuous hinges are often economically made by an injection molding process. Such parts require very few, if any, machining or finishing operations, and very little material, if any, is wasted. In addition, the cycle time of molding and releasing the completed plastic articles, when low, can be extremely cost effective. However, one of the most significant costs involved in the injection molding process is in the manufacturing of the mold itself. The cost of the mold substantially increases when higher tolerances are required. In addition, when holes are required in the finished molded product, special axially moveable rods or pins must be provided to form such holes. This increases the initial and maintenance costs of the mold. This also increases the cost of molding each part since the pin must travel a considerable distance as it is inserted and removed for each cycle. The long mold pin must be translated axially in an out for substantially the full length of the piano hinge during each molding cycle. The longer the mold pin, the longer the insertion and removal time. The length of the cycle time, and the associated cost, thus increase as the length of the mold pin increases. Undesirably, a piano hinge features all of these cost increasing characteristics. Higher tolerances are required across numerous holes in the knuckles or lugs. If the mold pin is not accurately and positively supported, the resulting hinge will bind, which is unacceptable. The production of these holes requires that a long mold pin be accurately supported and linearly inserted and extracted for substantially the full length of the part with each molding cycle. This substantially increases the cycle time of the process. The costs and difficulties are further multiplied when, as is often required in mass production, multiple cavity molds are used to make a multitude of parts in one injection cycle. With shorter conventional hinges the mold pins are shorter, the molds are cheaper to make and maintain, and the cycle times are significantly lower. Thus, the costs associated with producing an injection molded long plastic piano hinge are typically higher than those to produce two conventional plastic hinges of the same combined length.

One previous expedient that has been proposed to avoid producing a continuous one piece plastic piano hinge is found in Krolick U.S. Pat. No. 4,651,382. In Krolick, a plurality of short solvent bondable plastic hinges are disclosed to replace a metal hinge. These short hinges are generally of a typical hinge configuration and are quite well known in the art to be cost effectively made by the injection molding process. One of the configurations in Krolick shows a piano hinge assembled from a plurality of the short plastic hinges attached in a chain. Each hinge pin of the plurality of short plastic hinges is offset so as to interlock with an adjacent hinge. The combination of the short hinges forms the piano hinge. This configuration, while it avoids the difficulties and expenses of injection molding one continuous leaf piano hinge, has its own disadvantages. For example, labor costs in assembly are undesirably substantially increased as each hinge pin must be offset and interconnected to an adjacent hinge. Errors in assembly can result in rejected parts, including the hinged members to which the hinges are mounted. Assembly time is undesirably increased since each hinge must be individually bonded to the object to be hinged. In addition, numerous separate parts must be made in order to produce just one piano hinge.

Those concerned with these problems recognize the need for an improved, more cost effective all plastic continuous hinge that is similar in function to a conventional piano hinge, that can be more easily mass produced by the injection molding process at the lowest possible cycle time, that requires a minimal amount of labor to assemble, and that uses a minimal amount of plastic material.

These and other difficulties of the prior art have been overcome according to the present invention.

BRIEF SUMMARY OF THE INVENTION

A preferred embodiment of the elongated plastic hinge according to the present invention comprises two elongated hinge leaves, and two shortened knuckle or lug portions extending for less than the length of the leaves generally adjacent the opposed ends of the hinge leaves so as to provide an open spine with the alignment of a full spine. Each elongated hinge leaf has a body portion with at least two axially aligned and spaced apart lugs or knuckles projecting from an edge thereof. The hinge leaves also include an attachment surface adapted to allow the hinge to be solvent bonded to hinged members. Each lug contains an axially aligned pivot bore, and the lugs on one hinge leaf intermittently intermesh with lugs on the other hinge leaf to establish pivot connections once hinge pins are installed through the bores of each lug. Each set of intermeshed lugs forms one pivot connection. A measure of the openness of the hinge spine is provided by comparing the combined length of all of the pivot connections to the overall length of the hinge. The elongated plastic hinges according to the present invention have a pivot connection to hinge length ratio of less than about 0.8:1. It has been found that a pivot connection to hinge length ratio of between approximately 0.25–0.75:1 percent optimizes the material savings compared to a conventional piano hinge. According to one embodiment, a pivot connection to hinge length ratio of approximately 0.5:1 is preferred.

When more than two pivot connections are to be provided, it has been discovered that inexpensive snappedly engaging pivot portions provide particularly advantageous results. These snappedly engaging pivot portions reduce molding costs, reduce the amount of material used, and reduce assembly time. Unexpectedly, utilizing just two short hinge pins on just two pivot portions provides enough structural rigidity to prevent the hinge from separating during rough use where full piano hinges had customarily been used. These unique and desirous benefits significantly contribute to reducing the cost of the elongated plastic hinge so that they can be competitively mass produced by the injection molding process.

During the injection molding process a mass of molten thermoplastic plastic material is injected into a mold. The mold contains at least one cavity that is in the shape of a hinge leaf including the body and the lug portions. Where coaxially extending channels for receiving the pivot pins are to be located in the lug portions, the mold cavity includes a pair of spaced apart opposedly reciprocally mounted mold pins. The combined lengths of these mold pins are in the same proportions to the length of the hinge leaf shaped mold cavity as the pivot connections are to the length of the elongated hinge, that is, 0.8:1 or less. One molding cycle consists of closing the mold and reciprocating the mold pins toward one another to the full extend of their range of travel. In this fully inserted position they are disposed in a generally coaxial but spaced apart configuration. They are spaced apart by an amount that is at least equal to the open length of the spine of the hinge. The molten thermoplastic material is then injected into the hinge leaf shaped cavity and allowed to solidify. The mold pins are then reciprocated away from one another until they are completely withdrawn from the solidified hinge leaf. The mold is opened and the hinge leaf is ejected from the mold. Each of the mold pins travels less than one-half the length of the molded hinge leaf.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of molded plastic hinges. While the description which follows hereinafter is meant to be representative of a number of such applications, it is not exhaustive. As those skilled in the art will recognize, the basic apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
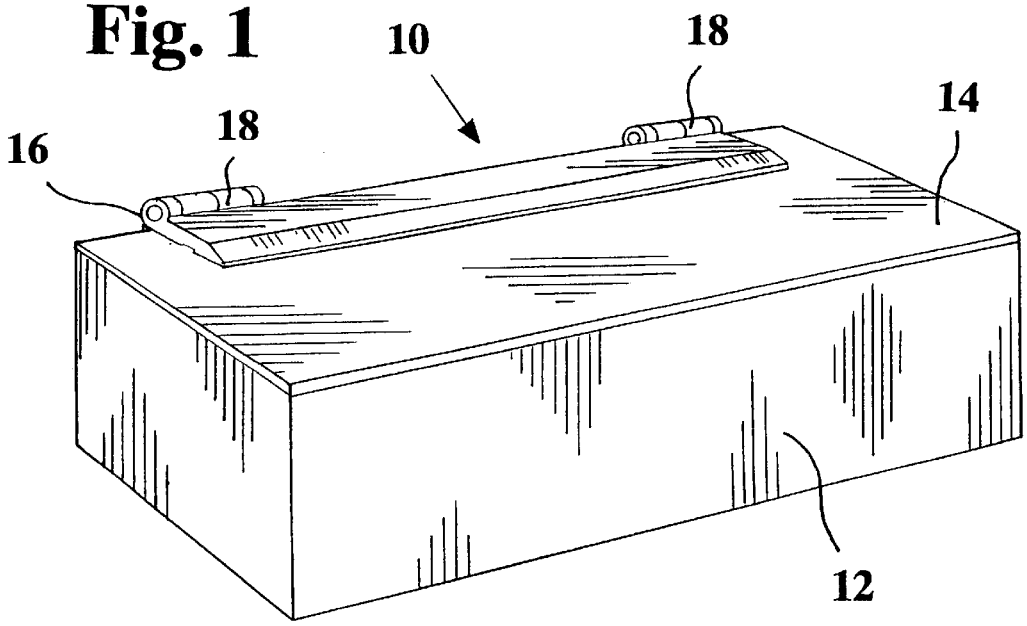
FIG. 1 is a perspective view of a preferred embodiment of a hinge according to the present invention after being solvent bonded to a plastic container.

Referring now to the drawings wherein like reference numerals designate identical or corresponding parts throughout the several views.

Referring particularly to FIG. 1, there is illustrated generally at 10 an all plastic container having a container portion 12 and cover portion 14 pivotally connected thereto via pivot connections 18. Pivot connections 18 are formed by intermeshed lugs that are mounted on the adjacent edges of the two leaves of elongated plastic hinge 16. The elongated plastic hinge 16 of the present invention is ideally suited to be solution bonded to containers or objects made of plastic, such as an acrylic, or the like. However, the elongated hinge of the present invention may also be adapted for conventional attachment to objects, such as, for example, by the use of screws, through-bolts, and glue, if desired.

The elongated plastic hinge of the present invention functions similarly to a conventional piano hinge, yet has many advantages over a conventional piano hinge made of plastic. For one, axially aligned pivot connections 18 are spaced apart so as to provide an open spine. This substantially reduces the amount of plastic material needed per hinge. In addition, the molding costs are substantially reduced since one long continuous mold pin is not required.

Figure 2:
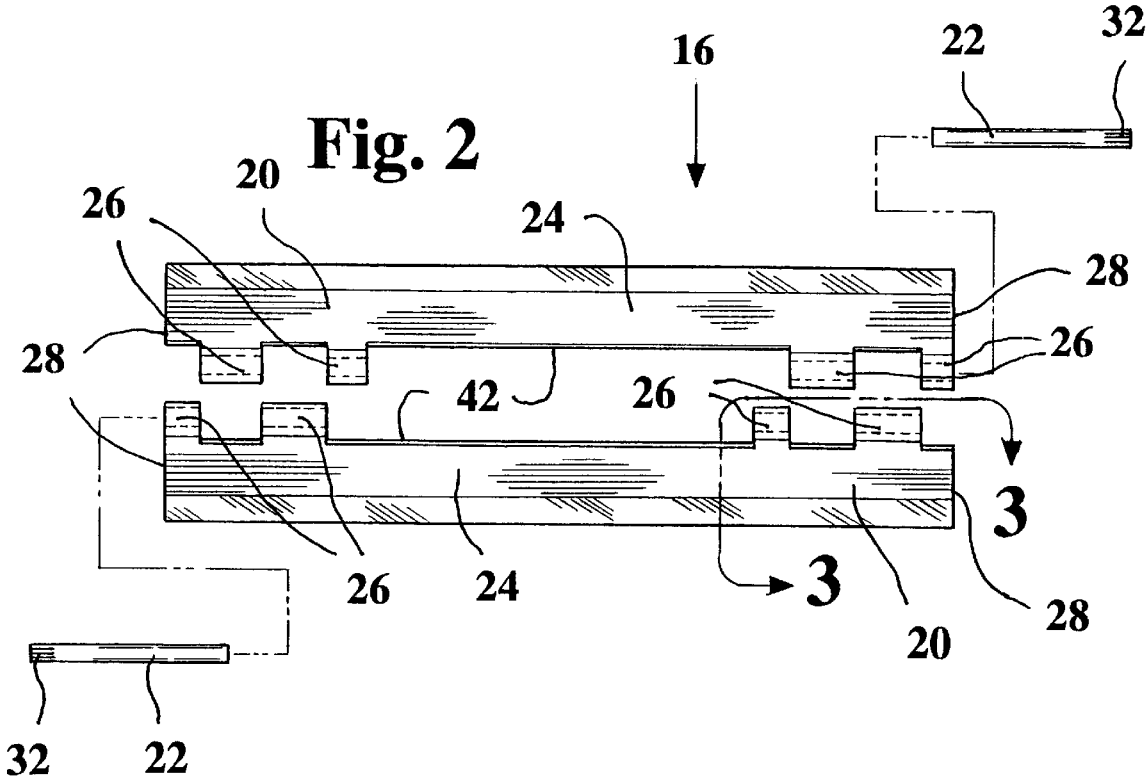
FIG. 2 is a generally exploded top view of one preferred embodiment of the present invention.

With particular reference to FIG. 2, there is generally illustrated at 16 an elongated plastic hinge of the present invention, prior to assembly. Uniquely, it has been discovered that this configuration utilizes only 60 percent of the material that would be required to produce a conventional continuous piano hinge, while retaining the advantages of a conventional piano hinge. The elongated plastic hinge 16 comprises two elongated hinge leaves 20 and two short hinge pins 22. Each elongated hinge leaf 20 comprises a body portion 24 having opposed ends 28, and four axially aligned and spaced apart lug portions 26 that define therebetween two pivot portions. Each pivot portion contains an axially aligned pivot bore 30, as shown, for example, in FIGS. 4 and 5. At least two lug portions are required for each hinge leaf, however, more than two may be used, if desired. Four lug portions per hinge leaf are used in the embodiment shown in FIG. 2. The lug portions 26 of each hinge leaf 20 are cooperatively disposed so as to intermesh with the lug portions 26 of the other hinge leaf to establish pivot connections 18 once hinge pins 22 are installed through the bores 30 of each lug portion. Preferably, the hinge pins have fastening ridges 32 that bind within the bore of the lug portion adjacent the opposed ends 28 so that the pins are secured in place. It is significant that the elongated hinge leaves 20 of the preferred embodiment are interchangeable. Because they are interchangeable, only one mold is necessary, and having just one mold configuration for the hinge significantly reduces manufacturing costs.

Figure 4:
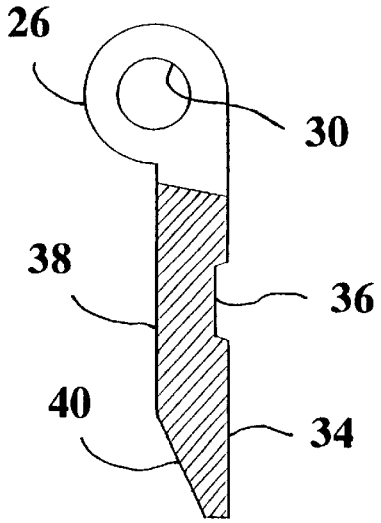
FIG. 4 is cross section view taken along line 4—4 in FIG. 3.
Figure 5:
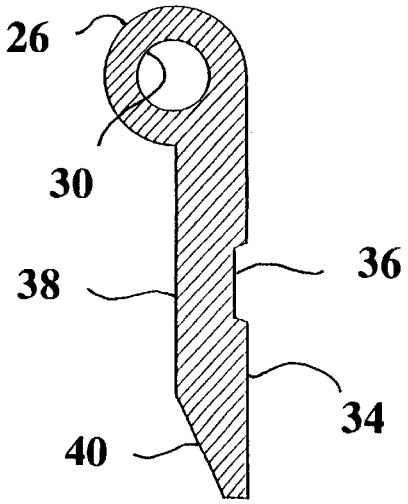
FIG. 5 is another cross section view taken along line 5—5 in FIG. 3.
Figure 3:
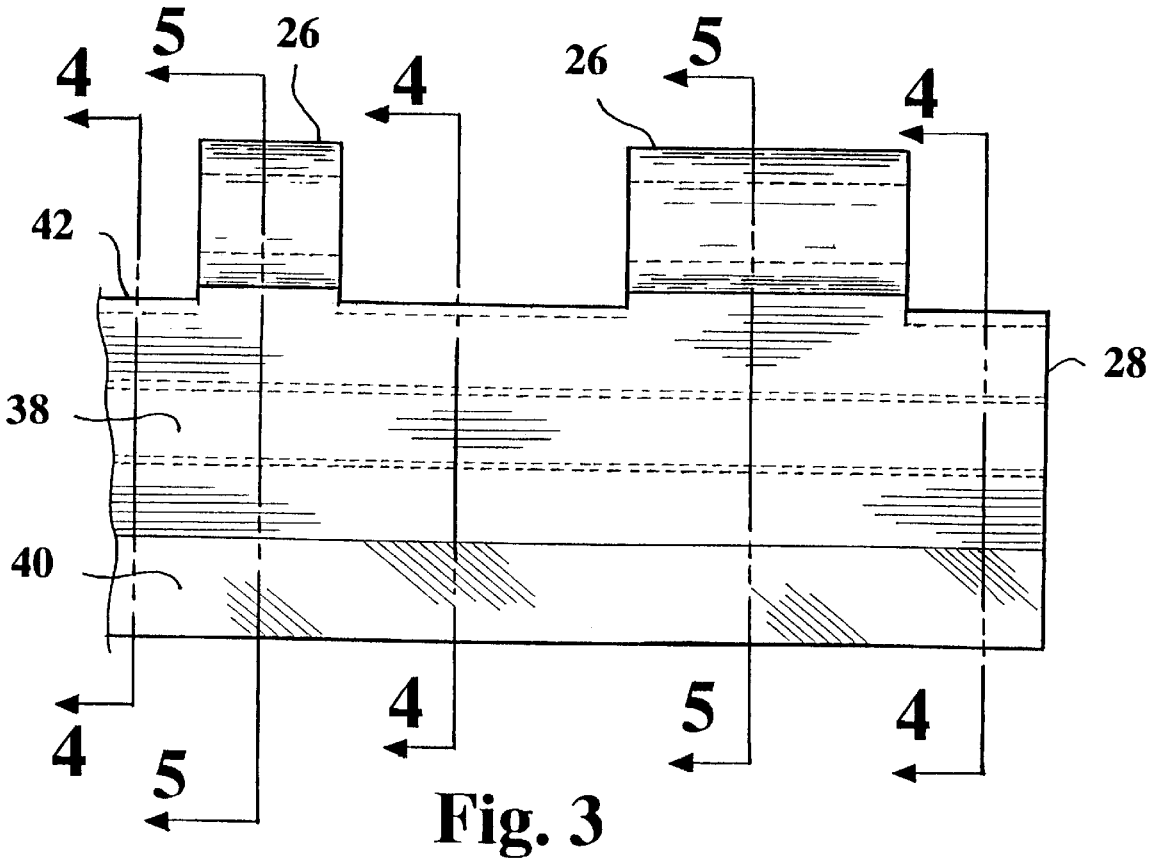
FIG. 3 is a fragmentary top view of one end of a hinge leaf of one preferred embodiment of the present invention.

The configuration of the elongated hinge leaves is shown in greater detail in, for example, FIGS. 3 through 5. The body portion 20 of the hinge leaves includes an attachment surface 34 and a solvent blocking groove 36 to prevent solvent bonding solution from approaching the pivot connections. The body portion 20 also includes a top surface 38 having a tapered portion 40. One important feature is the formation of a straight alignment edge 42 on the body portion of the hinge leaf in the region of the open spine between the pivot connections 18.

Figure 10:
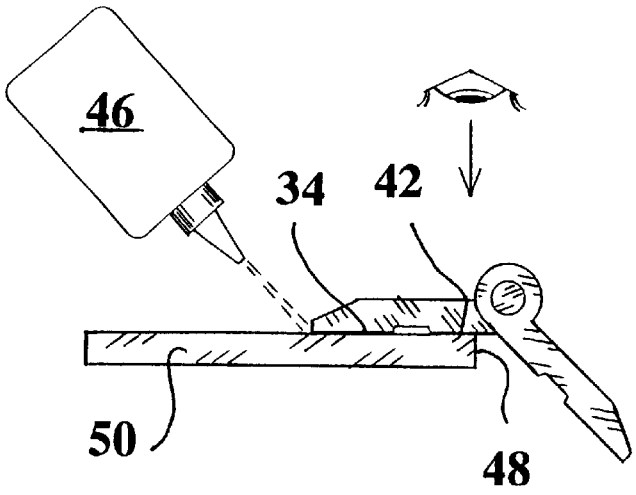
FIG. 10 is a side view of a preferred embodiment just prior to solution bonding to a hinged member.
Figure 11:
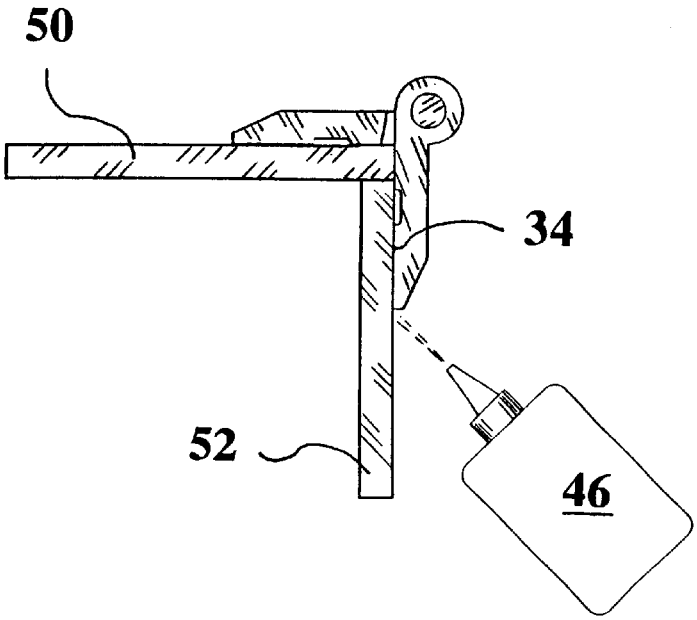
FIG. 11 is a side view of a preferred embodiment just prior to solution bonding to a second hinged member.

Referring, for example, to FIG. 10, alignment edge 42 assists in achieving proper alignment with first hinged member 50 during assembly. Prior to applying bonding solvent 46, alignment edge 42 can be viewed, as shown, against hinged member edge 48. Once the visual alignment is made, bonding solvent 46 can be applied to attachment surface 34. Referring to FIG. 11, second hinged member 52 can then be positioned and bonding solvent 46 can be applied to react with attachment surface 34 of the other hinge leaf.

Figure 6:
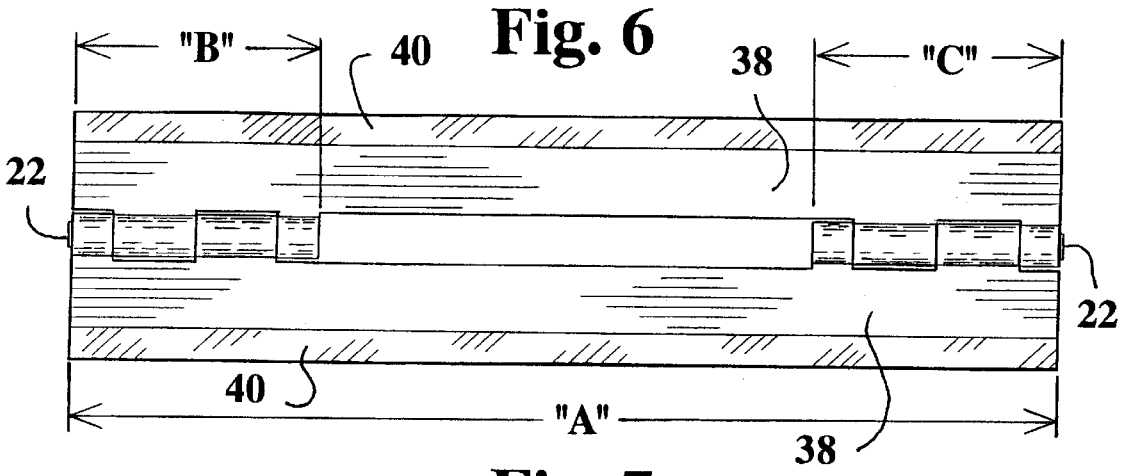
FIG. 6 is an assembled top view of one embodiment of the present invention.

The embodiment shown in FIGS. 2 through 5 are shown assembled in FIGS. 6 through 9. In this preferred embodiment, the hinge has a pivot connection to hinge length ratio of about 0.50:1, or expressed as a percent, 50 percent. At this ratio, approximately 40 percent savings of material is achieved compared to a comparable conventional piano hinge of the same length. The pivot connection to hinge length ratio is calculated by adding the total combined length of all pivot connections of the hinge and dividing by the entire length of the hinge. Referring to FIG. 6, the pivot connection to hinge length ratio is calculated as: Ratio= ("B"+"C")/"A". Multiplying the ratio by 100 expresses the ratio as a percentage. A ratio of about 80 percent or less is advantageous in reducing the costs due to the reduction in the amount of material needed for the pivot portions and the mold and molding costs. A ratio between approximately 25 percent to 75 percent is preferred as it has been found to optimize the material savings. For instance, a hinge having a pivot connection to hinge length ratio of about 80 percent or more would likely, for structural rigidity purposes, require additional thickness of the body portions of the leaf members. Increasing the thickness of the body portions to compensate for the reduction in rigidly due to the increased open spine length of the hinge can more than offset the material savings obtained by reducing the amount of pivot portions.

Figure 7:
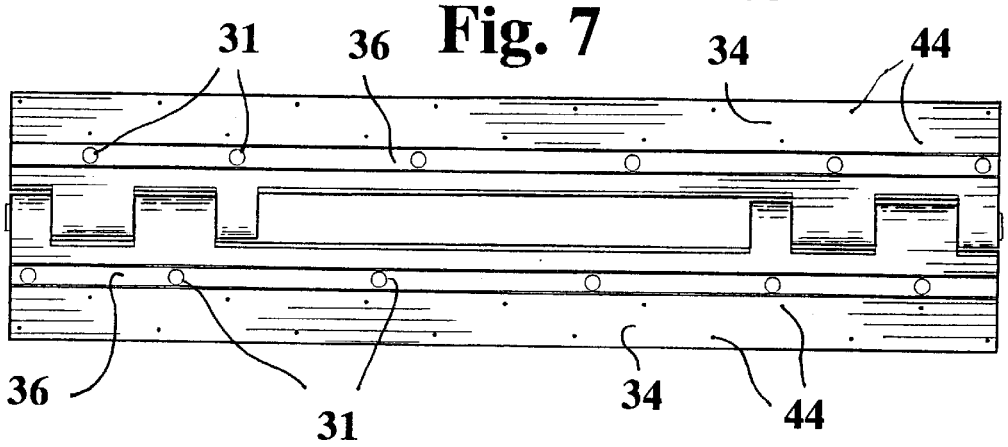
FIG. 7 is an assembled bottom view of the embodiment of FIG. 6.
Figure 8:
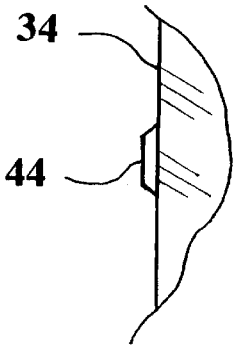
FIG. 8 is fragmentary side view of a bead protrusion of the embodiment of FIG. 9.
Figure 9:
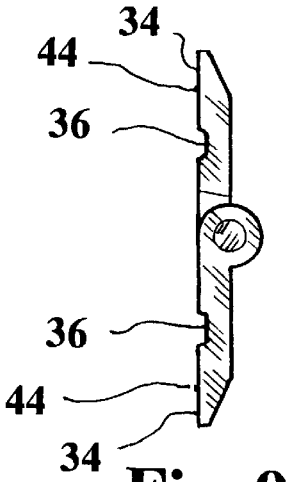
FIG. 9 is an assembled side view of the embodiment of FIG. 7.

The attachment surfaces 34 and solvent blocking grooves 36 are more particularly shown in FIG. 7 and FIG. 9. The embodiment is preferably produced by an injection molding process and is adapted to be solvent bonded to an object. Inside the solvent grooves 36 are the marks 31 left by the mold ejector pins. It is desirable to position the mold ejector pins such that the marks 31 are left in the solvent groove so that they do no interfere with attachment surface 34 when being aligned for solvent bonding. Preferably, small protuberances 44 are provided on the attachment surfaces of the hinge leaves so that the attachment surfaces can be maintained at a desired distance away from the bonding surface before the bonding solvent is applied. It has been found desirable to hold the attachment surfaces approximately 0.003 inches away from the bonding surface of the hinged member to be bonded to allow the bonding solvent to flow between the surfaces. The small protuberances 44 of the preferred embodiment therefore raise 0.003 inches from the attachment surface, and desirably disappear after being dissolved by the bonding solvent.

Figure 12:
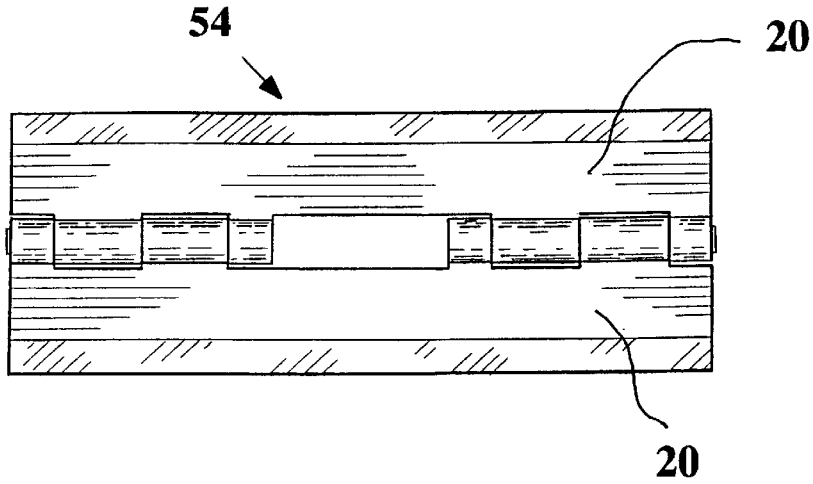
FIG. 12 is a top view of another preferred embodiment of the present invention.
Figure 13:
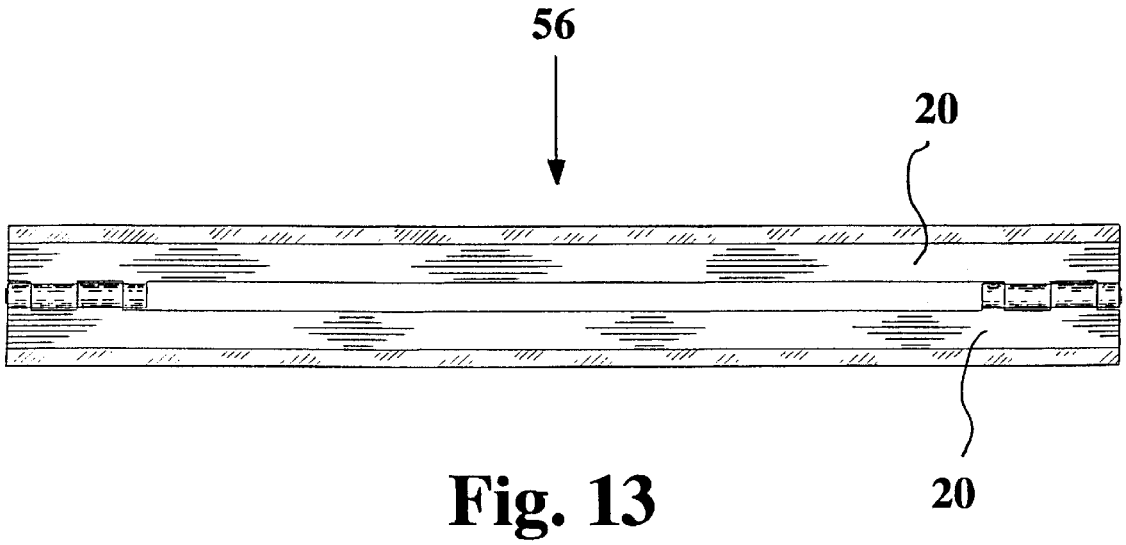
FIG. 13 is a top view of another preferred embodiment of the present invention.

Alternative embodiments are shown, for example, in FIGS. 12 through 19. The elongated plastic hinge 54 in FIG. 12 is identical to that shown in FIGS. 2 through 11, with the exception that it has a pivot connection to hinge length ratio of about 75 percent. The elongated plastic hinge 56 in FIG. 13 is also identical to that shown in FIGS. 2 through 11, but it has a pivot connection to hinge length ratio of about 25 percent. The open spine elongated plastic hinges of the present invention provide significant advantages over a conventional full length piano hinge. These advantages include a substantial reduction of the amount of plastic material per hinge, a substantial reduction in the complexity of the mold, and a substantial reduction in the cycle time.

Figure 14:
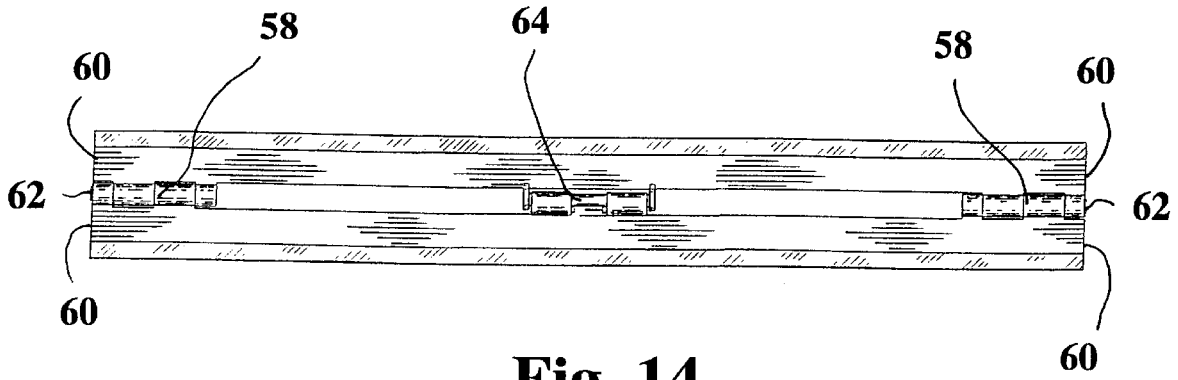
FIG. 14 is a top view of another preferred embodiment of the present invention.
Figure 15:
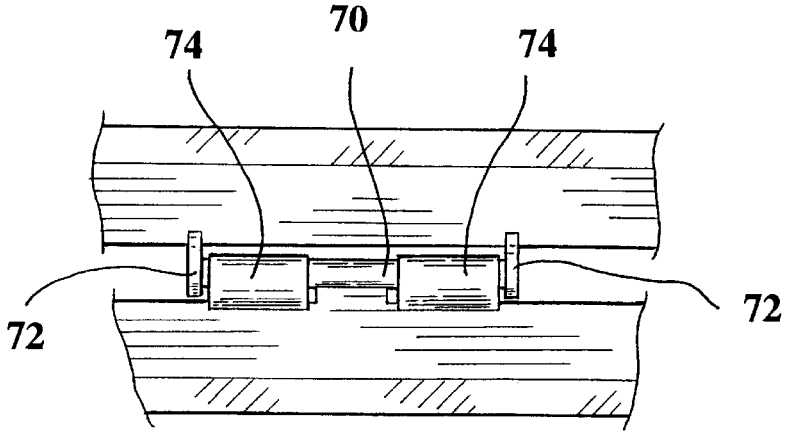
FIG. 15 is a fragmentary top view of the snappedly engaging pivot connection of FIG. 15.
Figure 16:
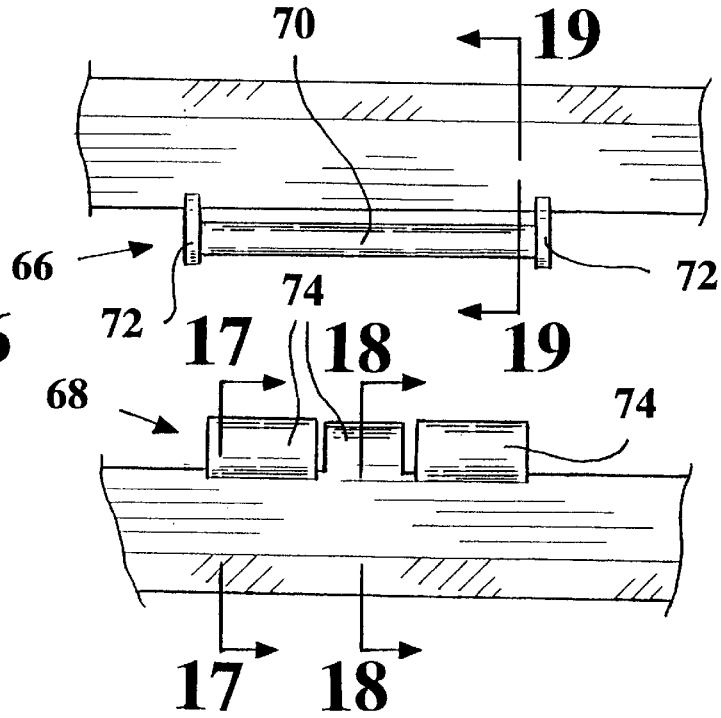
FIG. 16 is a fragmentary partially exploded top view of the pivot connection shown in FIG. 15.
Figure 17:
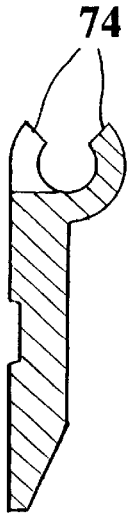
FIG. 17 is a cross sectional view taken along line 17—17 in FIG. 16.
Figure 18:
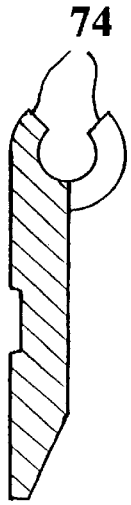
FIG. 18 is a cross sectional view taken along line 18—18 in FIG. 16.
Figure 19:
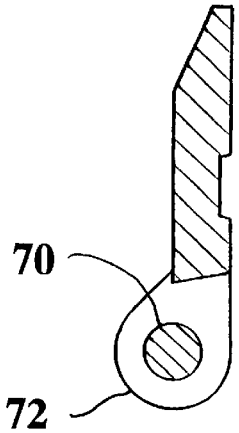
FIG. 19 is a cross sectional view taken along line 19—19 in FIG. 16.

FIG. 14 shows an alternative embodiment having three pivot connections. The pivot connections 58 adjacent the opposed ends 60 of the hinge leaves are similar to those shown in the embodiments of FIG. 2 through 13. Importantly, these pivot connections 58 with hinge pins 62 installed prevent the hinge from being pulled apart when the hinged members are handled roughly. Uniquely, pivot connection 64 does not utilize a removable hinge pin. Referring to FIGS. 15 through 19, pivot connection 64 comprises pivot members 66 and 68 which snappedly engage one another to establish the pivot connection. Pivot member 66 includes integral pivot bar 70 integrally attached to the edge of the hinge leaf body via support tabs 72. Pivot member 68 includes integral c-clamp portions 74 which snappedly engage pivot bar 70. The snapped pivot connection is constructed entirely of components that are molded integrally with the leaves. When present, the length of the snapped pivot connection is included in calculating the ratio of the pivot connection to the length of the hinge. The length of the snapped pivot connections is however, not included in calculating the ratio of the combined mold pin lengths to the length of the molded hinge leaf, because there is no moveable mold pin in the snapped pivot connection. It has been discovered that this pivot connection configuration, when used in conjunction with pivot connections 58 provides a significant cost savings advantage. For one, the snapped engagement configuration greatly assists assembly of the hinge by holding the hinge leaves in proper alignment for installation of the hinge pins 62. In addition, additional hinge pins are not required when snappedly engaging pivot connections are used. Furthermore the molds incorporating the snappedly engaging pivot connections are easier to make and are less expensive than those utilizing the hinge pin configuration, because the mold pin which forms the C-clamp sections 74 is mounted in a fixed position in within the mold. The mold pin is not withdrawn and reinserted with each molding cycle. Preferably, two hinge pin pivot connections 58 are used in order to structurally stabilize the hinge pin, with additional pivot connections being of the snapped configuration. It is undesirable however, to utilize only snappedly engaging pivot connections in an elongated hinge since mishandling of the hinged members can cause the hinge to separate.

One of the significant advantages of a full length hinge as against, for example, two short separate hinges is that the extended mounting surfaces contribute significantly to the strength of the assembled structure. A six inch long hinge, according to the present invention, with two one and one half inch long lug portions provides substantially more mounting surface than two one and one half inch long hinges, and is less expensive than two three inch long hinges.

What have been described are preferred embodiments in which modifications and changes may be made without departing from the spirit and scope of the accompanying claims. obviously, many modifications and variations of the present invention are possible in light of the above teachings. It is therefore to be understood that, within the scope of the appended claims, the invention may be practiced otherwise than as specifically described.

What is claimed is:

1. An elongated plastic hinge having an open spine and adapted to being mounted to and pivotally connecting two generally flat hinged members, said hinge comprising:

two elongated hinge leaves, each said hinge leaf having a body portion, each said body portion having an attachment surface for attachment to a respective said hinged member, each said hinge leaf having at least two axially aligned and spaced apart lug portions, each said lug portion being integral with said respective body portion; each said lug portion of each said hinge leaf cooperably intermeshing with a. respective said lug portion of the other hinge leaf thereby establishing at least two pivot connections, said pivot connections being spaced apart by a distance such that the ratio of the combined length of said pivot connections to the overall length of said elongated plastic hinge is less than about 0.8:1, and a plurality of generally equally sized bead protrusions on said attachment surfaces of each said hinge leaf adapted to space said attachment surfaces a predetermined distance from said hinged members.

2. An elongated plastic hinge having an open spine and adapted to being solvent bonded to and pivotally connecting two generally flat hinged members, said hinge comprising:

two elongated hinge leaves, each said hinge leaf having a body portion, each said body portion having an attachment surface for attachment to a respective said hinged member, each said hinge leaf having at least two axially aligned and spaced apart lug portions, each said lug portion being integral with said respective body portion; each said lug portion of each said hinge leaf cooperably intermeshing with a respective said lug portion of the other hinge leaf thereby establishing at least two pivot connections, said pivot connections being spaced apart by a distance such that the ratio of the combined length of said pivot connections to the overall length of said elongated plastic hinge is less than about 0.8:1, and said attachment surfaces having a groove extending substantially the entire length of each said hinge leaf, said groove being adapted to blocking said solvent from flowing over said pivot connections.

3. An elongated plastic hinge having an open spine and adapted to being assembled to and pivotally connecting two generally flat hinged members, said hinge comprising:

two elongated hinge leaves, each said hinge leaf having a body portion, each said body portion having an attachment surface for attachment to a respective said hinged member, each said hinge leaf having at least two axially aligned and spaced apart lug portions, each said lug portion being integral with said respective body portion; each said lug portion of each said hinge leaf cooperably intermeshing with a respective said lug portion of the other hinge leaf thereby establishing at least two pivot connections, said pivot connections being spaced apart by a distance such that the ratio of the combined length of said pivot connections to the overall length of said elongated plastic hinge is less than about 0.8:1, and said hinge leaves include snapped connection components integrally formed therewith and located between said pivot connections.

4. An elongated plastic hinge having an open spine and adapted to being mounted to and pivotally connecting two generally flat hinged members; said elongated hinge comprising:

two elongated hinge leaves, each said hinge leaf having a body portion, said body portion having opposed ends, each said body portion having an attachment surface for attachment to a respective said hinged member, each said hinge leaf having at least two axially aligned and spaced apart lug portions, each said lug portion being integral with said respective body portion, each said lug portion of each said hinge leaf cooperably intermeshing with a respective said lug portion of said other hinge leaf thereby establishing spaced apart pivot connections, said pivot connections cooperably establishing pivotal interconnection between said hinge leaves, said elongated hinge having a pivot connection to hinge length ratio of about 80 percent or less, at least two said pivot connections being established with snappedly interengaging snapped connection components.

* * * * *